United States Patent [19]

Price et al.

[11] Patent Number: 4,922,064

[45] Date of Patent: May 1, 1990

[54] DOOR POSITION INDICATOR

[75] Inventors: Dean C. Price, Kerrville; Quentin H. Young, San Antonio, both of Tex.

[73] Assignee: Adtec Incorporated, San Antonio, Tex.

[21] Appl. No.: 320,702

[22] Filed: Mar. 8, 1989

[51] Int. Cl.[5] ..... H01H 3/16; G08B 13/08

[52] U.S. Cl. ..... 200/61.7

[58] Field of Search ..... 200/61.62, 61.7; 340/545-549

[56] References Cited

U.S. PATENT DOCUMENTS

| | | | |
|---|---|---|---|
| Re. 30,716 | 8/1981 | Suska | 200/61.7 |
| 3,659,063 | 4/1972 | Peterson | 200/61.7 |
| 3,806,852 | 4/1974 | Suska | 335/205 |
| 3,838,234 | 9/1974 | Peterson | 200/61.7 |
| 3,896,404 | 7/1975 | Peterson | 335/205 |
| 4,049,934 | 9/1977 | Newlon | 200/61.7 |
| 4,066,857 | 1/1978 | Suska | 200/61.7 |
| 4,168,409 | 9/1979 | McNinch | 200/61.7 |
| 4,359,719 | 11/1982 | Schwarzer | 340/287 |
| 4,438,430 | 3/1984 | Young et al. | 340/547 |
| 4,721,946 | 1/1988 | Zunkel | 200/61.7 X |

FOREIGN PATENT DOCUMENTS

| | | | |
|---|---|---|---|
| 1279381 | 6/1972 | United Kingdom | 200/61.7 |
| 1333034 | 10/1973 | United Kingdom | 200/61.7 |

*Primary Examiner*—J. R. Scott

*Attorney, Agent, or Firm*—Nydegger & Harshman

[57] ABSTRACT

A door position indicator for indicating when the door is open or ajar from the doorjamb comprises a proximity switch which is adjustably mounted on the frame leaf attached to the doorjamb. An actuator is adjustably mounted on the door leaf attached to the door and positioned thereon for alignment with the proximity switch when the door is closed. The indicator also comprises a spring which urges the actuator toward the proximity switch when the actuator and switch are aligned.

14 Claims, 2 Drawing Sheets

DOOR POSITION INDICATOR

FIELD OF THE INVENTION

This invention relates generally to door position indicators. More specifically, the present invention relates to sensing devices for a security system which can be operatively mounted in the knuckles of door hinge leafs to indicate when the door is ajar. This invention is particularly, but not exclusively, suited for use with doors, gates and other similar barriers in places such as banks, homes or correctional facilities when it is essential to know whether to barrier is open or ajar.

BACKGROUND OF THE INVENTION

Wherever there is the need for a security system, there is also a need for sensing devices which will indicate when a barrier has been comprised. In specific instances where the barrier is a door or a gate, it may be important to known when the barrier is even slightly ajar. An ability to detect even the slightest opening of a door or gate is of obvious importance in bank buildings, financial instutitions, prison, and correctional facilities.

In order to be effective as part of a security system, a door position indicator must be extremely sensitive to changes in the configuration of the door. Indeed, a door which can be even slightly opened without alarming the system may allow deactivation of the door position indicator to permit an undected further opening of the door. Consequently, sensitivity of the door position indicator is crucial to the effectiveness of the security system. Further, it is important that the door position indicator be concealed and tamper resistant for security purposes. Additionally, it is important that the door position indicator be easily adjusted, even subsequent to its installation, to maintain the sensitivity of the indicator.

Several examples of door position indicators can be given. For example, U.S. Pat. No. 3,806,852 to Suska discloses a switch activating hinge which relies on the juxtaposition of the hinge leaves for a door closed indication. Somewhat differently, U.S. Pat. No. 3,838,234 to Peterson discloses an interrupt electrical circuit which is activated by mechanisms held in the knuckles of the door hinge to indicate whether the door is closed or open. U.S. Pat. No. 4,049,934 to newlon, like the Peterson patent, discloses a device held in knuckles of the hinge. The Newlon patent, however, discloses an adjustable component for its security hinge. None of these devices, however, are able to be readjusted after some misalignment of its mechanism while the door remains operable.

The present invention recognizes that an extremely sensitive door position indicator is needed to provide effective security. Further, the present invention recognizes this sensitivity can be disturbed to give erroneous indications at any time after installation. Thus, there is a need for the ability to easily adjust the indicator back into its proper working configuration, without dismantling the door, even though the maladjustment occurs after the door has been installed.

In light of the above, it is an object of the present invention to provide a door position indicator which is very sensitive to the condition of the door whether it be open, closed or merely ajar. Another object of the present invention is to provide a door position indicator which is adjustable to maintain proper door position indications even after the door has been installed. Still another object of the present invention is to provide a door position indicator that is concealed from view and substantially tamper resistant. Yet another object of the present invention is to provide a door position indicator that is relatively easy to install and operate, relatively simple to manufacture and comparatively cost effective.

SUMMARY OF THE INVENTION

A preferred embodiment of the novel door position indicator of the present invention includes an actuator and a proximity switch responsive to the actuator. The actuator, in combination with an actuator housing, is adjustably mounted on the kunckle of a door leaf that is attached to the door. The proximity switch, and its associated housing, is adjustably mounted on the knuckle of a frame leaf that is attached to the doorjamb. If both are properly adjusted, the actuator is brought into alignment with the proximity switch whenever the door is closed. In this configuration, i.e. the actuator is aligned with the proximity switch, the proximity switch is activated to an OFF condition to indicate that the door is closed. In order to permit greater sensitivity for the door position indicator, the actuator housing includes a spring which urges the actuator toward and close to the proximity switch when the two are in alignment.

The knuckle of the frame leaf has a hinge pin which engageable with the knuckle of the door leaf to allow hinge pin has an extension which is positioned to urge the actuator into alignment with the proximity switch during initial mounting of the door on the doorjamb or subsequently whenever there has been a misalignment of the actuator and proximity switch.

The novel features of this invention as well as the invention itself, both as to its organization and operation, will be best understood from the accompanying drawings taken in conjunction with the accompanying description in which similar reference characters refer to similar parts and in which:

DESCRIPTION OF THE PREFERRED EMBODIMENT

Figure 1:
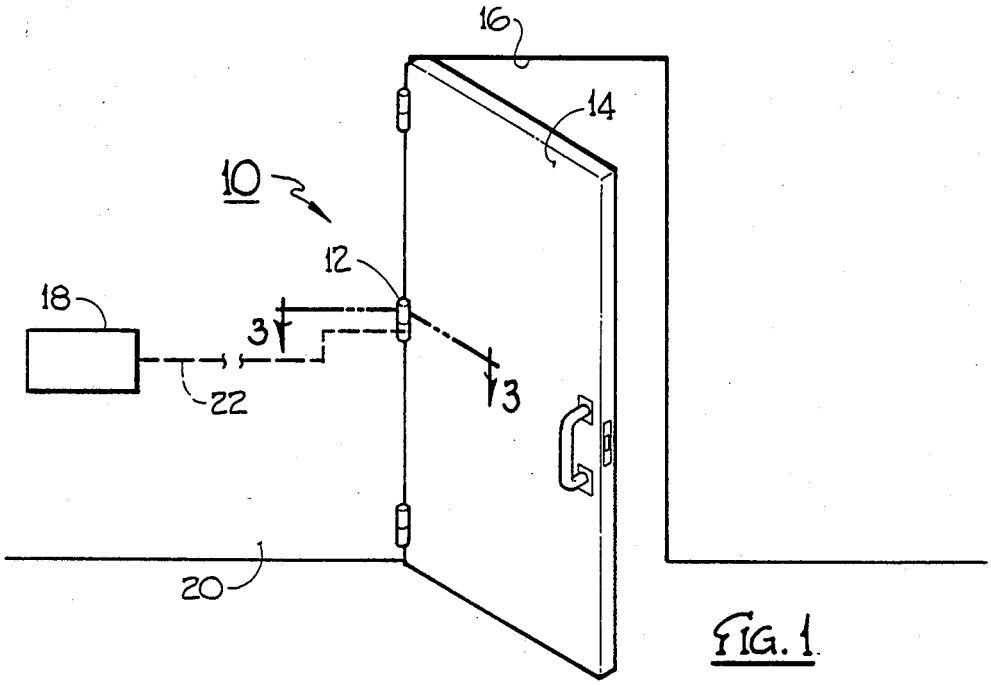
FIG. 1 is a perspective view of the door position indicator of the present invention shown in its connection between a door and a doorframe.

Referring initially to FIG. 1, a security system incorporating the door position indicator of the present invention is shown and generally designated 10. As shown, system 10 comprises a hinge assembly 12 which operatively connects a door 14 to a doorjamb 16. A display panel 18 may be mounted on wall 20, or otherwise conveniently located, and electrically connected to hinge assembly 12 via line 22, by any means well-known in the art, to indicate the condition of hinge assembly 12. Specifically, display panel 18 can have visual or audio alarms which indicate the condition of hinge assembly 12 and, consequently, whether door 14 is closed or ajar.

Figure 2:
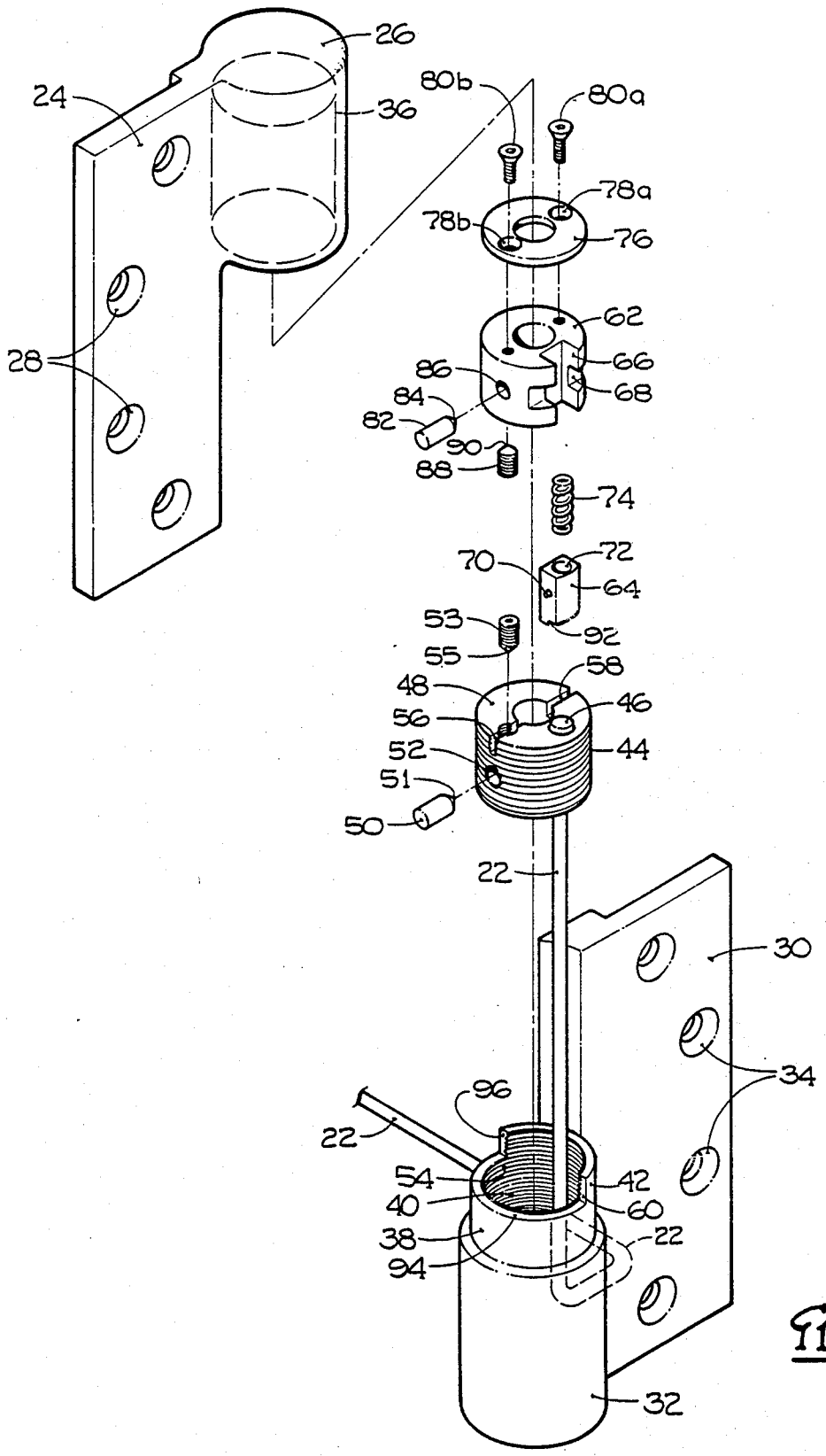
FIG. 2 is an exploded perspective view of the door position indicator.

Referring now to FIG. 2, it will be seen that hinge assembly 12 comprises a door leaf 24 that has a knuckle 26. As is typical, door leaf 24 is formed with holes 28, substantially as shown, which are used for attaching door leaf 24 to door 14 in a manner well known in the art such as with tamper resistant screws (not shown). In addition to the door leaf 24, hinge assembly 12 also includes a frame leaf 30 which has a knuckle 32. Like door leaf 24, frame leaf 30 is formed with holes 34 for attaching frame leaf 30 to jamb 16 in a manner well known in the art such as with tamper resistant screws (not shown). As seen in FIG. 2, knuckle 26 of door leaf 24 is formed with a cavity 36 (shown in pahntom) which receives the hinge pin 38 of knuckle 32 to hingedly connect door 14 to jamb 16. As will be appreciated, the purpose of this connection is to pivot door 14 about an axis substantially parallel to the jamb 16 to open and close door 14. FIG. 2 also shows that hinge pin 38 of knuckle 32 is formed with a cavity 40 and an extension 42.

A switch housing 44 is provided to hold a proximity switch 46. Proximity switch 46 may be of any of several types well known in the pertinent art, such as Model No. 922FSO, 8-A4P-020 manufactured by MICRO SWITCH. Alternatively, proximity switch 46 can be replaced with a Hall effect device of a type well known in the art. Indeed, many well known switching devices can be used for the present invention. Importantly, however, proximity switch 46 or an alternative device should be very directionally sensitive, e.g. proximity switch 46 should have a responsive sensitivity in a direction substantially perpendicular to the surface 48 of switch housing 44 that is less than an approximated three thirty-seconds of an inch (3/32 inch). As shown in FIG. 2, proximity switch 46 is electrically connected directly to line 22.

FIG. 2 also shows that a nylon friction plug 50 having a conical point 51 is seated into a recess 52 on the side of switch housing 44. Further, a set screw 53 having a conical point 55 is threadably engageable with a recess 56 in the housing 44. Both conical points 51, 55 of friction plug 50 and set screw 53 touch each other when plug 50 and set screw 53 are seated or engaged in their respective recesses 52, 56. With this combination, set screw 53 may then be threadably advanced into recess 56 to urge its conical point 55 against conical point 51 of friction plug to pressure the plug 50 out of recess 52. Consequently, when switch housing 44 is placed into the cavity 40 of hinge pin 38, an advancement of set screw 53 urges friction plug 50 against the side 54 of recess cavity 40. As a further consequence, with an increased pressure of plug 50 against sides 54, the resistance to rotation of housing 44 in cavity 40 is also increased. A slot 58 is formed on surface 48 of housing 44 to rotate housing 44 against the adjusted resistance of plug 50 to position proximity switch 46 relative to the edge 60 of extension 42 as desired. Once the proximity switch 46 is properly positioned, set screw 53 may then be further tightened to hold switch housing 44 in the desired position.

FIG. 2 also shows that hinge assembly 12 comprises an actuator housing 62 and an associated actuator 64 which is mounted on the housing 62. Actuator housing 62 is shown to be formed with a slot 66 and a groove 68. In order to help hold actuator 64 in the slot 66, actuator 64 is made with a pair of seating pins which only the seating pin 70 on the rear side of actuator 64 is shown in FIG. 2. Further, actuator 64 is formed with a hole 72 for receiving a portion of spring 74. Additionally, there is a spring retainer plate 76 which is formed with holes **78*a* and 78*b* through which screws 80*a* and 80*b* can be respectively inserted and engaged with housing actuator housing 62 to hold plate 76 on housing 62. Thus, when assembled, actuator 64 is slidably positioned within the slot 66 with the seating pins 70 respectively extending laterally in opposite directions into the groove 68. Spring 74 is inserted into hole 72 of actuator 64 and presses against both actuator 64 and spring retainer plate 76 which is attached to actuator housing 62** as indicated above.

As indicated in FIG. 2, actuator housing 62 is operatively positioned in cavity 36 of knuckle 26 of door leaf 24. To accomplish this, and hold actuator housing 62 in the cavity 36, a friction plug 82 having a conical point 84 is received into a recess 86 in actuator housing 62. Preferably friction plug 82 is made of nylon. Set screw 88 having a conical point 90 is threadably engaged with a recess (not shown) on actuator housing 62 and advanced therethrough until conical point 90 of set screw 88 is in contact with conical poing 84 of friction plug 82. Thus, in a manner similar to that disclosed above for the cooperation of set screw 53 and friction plug 50 in adjustably holding switch housing 44 in knuckle 32, set screw 88 and friction plug 82 cooperate to adjustably hold actuator housing 62 in cavity 36 of knuckle 26. Importantly, set screw 88 can be advanced into actuator housing 62 to urge friction plug 82 against the side of cavity 36 with an adjustable pressure. This will allow rotation of actuator housing 62 in response to an applied force and hold actuator housing 62 in knuckle 26 in the absence of an applied force.

OPERATION

Figure 3:
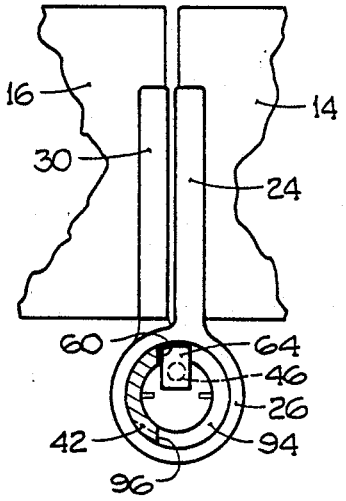
FIG. 3 is a cross-sectional view of the door position indicator as seen along the line 3—3 in FIG. 1 with the door closed.
Figure 4:
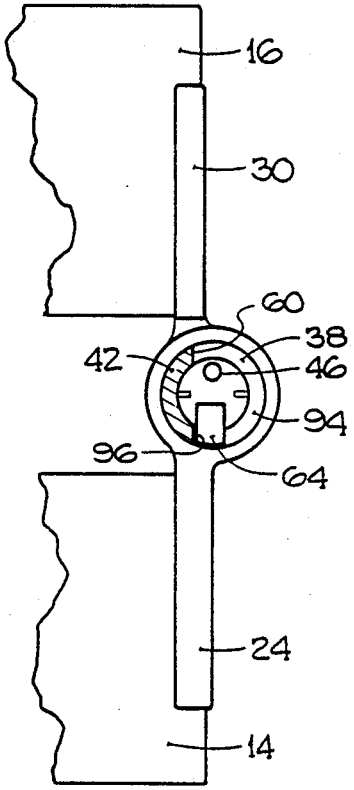
FIG. 4 is a cross-sectional view of the door position indicator as seen along the line 3—3 in FIG. 1 with the door completely opened.

The operation of hinge assembly 12 will be best appreciated by reference to FIG. 3 and FIG. 4. In FIG. 3, door 14 is shown in a closed position. When door 14 is closed, it can be seen that actuator 64 is aligned with proximity switch 46 (shown in phantom). This alignment will activate switch 46 to an ON condition and relay an appropriate signal via line 22 to display panel 18. The sensitivity of proximity switch 46 is such that an ON condition is indicated only when there is very close alignment between the actuator 64 and switch 46. This sensitivity is enhanced by the fact that spring 74 urges actuator 64 toward the proximity switch 46 when the two are in alignment as shown in FIG. 3. Referring for the moment back to FIG. 2, it will be seen that actuator 64 is formed with a notch 92 which is urged by spring 74 against the rim 94 of hinge pin 38. Thus, variations in distance between knuckle 26 and knuckle 32 can be compensated for and actuator 64 is urged into close proximity with switch 46 when they are aligned.

Whenever door 14 is open or ajar, actuator 64 is moved out of alignment with proximity switch 46 and the switch 46 is activated to an OFF condition which is relayed to display panel 18 via line 22 for an appropriate indication. It will be appreciated that the ON and OFF conditions of switch 46 are interchangeable and are used here only for purposes of indicating a change in the condition of switch 46.

It may happen, for any number of reasons, that actuator 64 may be knocked out of alignment. This condition, however, is easily rectified. By completely opening door 14, slightly beyond the position as shown in FIG.

4 (i.e. beyond 180°), actuator 64 can be brought into effective contact with edge 96 of extension 42. This will cause actuator 64 and actuator housing 62 to rotate counter-clockwise within cavity 36, from the perspective of FIG. 3 or FIG. 4. In the case of an exaggerated miss-alignment, door leaf 24 can be removed from door 14. With door leaf 24 removed, door 14 can be returned to its closed position and door leaf 24 reengaged with frame leaf 30 at approximately the 180° position shown in FIG. 4. Door leaf 24 can then be rotated counter clockwise as described above to reorient actuator housing 62 relative to door leaf 24 to correctly position actuator 64 for subsequent alignment with proximity switch 46. With actuator 64 so oriented, door 14 can then be reopened and door leaf 24 remounted on door 14. In either case, the rotation of actuator housing 62 will be against the action of plug 82 on the side of cavity 36 and will position actuator 64 in cavity 36 for contacting edge 60 of extension 42 when the door 14 is closed as shown in FIG. 4. It will be appreciated that actuator 64 will normally come into contact with edge 60 regardless whether it was ever necessary for actuator 64 to contact edge 96. In either case, hinge assembly 12 can be self-adjusted to insure that actuator 64 and switch 46 are always aligned to properly indicate an ON condition for switch 46 whenever door 14 is closed.

While the particular device as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

We claim:

1. A device for indicating the opened and closed position of a door relative to its associated jamb which comprises:

a frame leaf formed with an extention, said frame leaf being fixedly mounted on said jamb;

a proximity switch changeable between an ON and an OFF condition and fixedly positioned on said frame leaf;

a door leaf fixedly mounted on said door; and an actuator adjustably mounted on said door leaf for movement therewith into proximity with said switch to activate said switch into an ON condition when said actuator is in proximity with said switch and for adjustable movement on said door leaf into alignment with said switch upon contact of said actuator with said extension.

2. A device for indicating the opened and closed position of a door as recited in claim 1 wherein said door leaf has a knuckle, said door leaf being fixedly attached to said door and said actuator being adjustably mounted on said knuckle of said door leaf; and wherein said frame leaf has a knuckle, said frame leaf being fixedly attached to said jamb and said proximity switch being rotatably mounted on said knuckle of said frame leaf.

3. A device for indicating the opened and closed position of a door as recited in claim 2 further comprising an actuator housing for mounting said actuator thereon, said actuator housing having means for releasably holding said actuator housing in said knuckle of said door leaf.

4. A device for indicating the opened and closed position of a door as recited in claim 2 further comprising a switch housing for mounting said proximity switch thereon, said switch housing having means for releasably holding said proximity switch in said knuckle of said frame leaf.

5. A device for indicating the opened and closed position of a door as recited in claim 2 further comprising means for urging said actuator toward said proximity switch.

6. A device for indicating the opened and closed position of a door as recited in claim 2 wherein said knuckle of said leaf frame is formed with a hinge pin, said hinge pin being engageable with said knuckle of said door leaf for rotation of said door about said axis substantially parallel to said jamb.

7. A device for indicating the opened and closed position of a door as recited in claim 6 wherein said hinge pin is formed with an extension, said extension being selectively engageable with said actuator to urge said actuator into position for alignment with said proximity switch to change said switch to the ON condition when the door is closed.

8. A device for indicating the opened and closed position of a door as recited in claim 1 further comprising an alarm electronically connected to and activated by the OFF condition of said proximity switch to indicate when the door is open or ajar.

9. A door hinge assembly for indicating when the door is ajar from its associated jamb which comprises:

a door leaf with a knuckle, said door leaf being fixedly mounted on said door;

a frame leaf with a knuckle having an extension, said frame leaf being fixedly mounted on said jamb;

an actuator adjustably mounted on said knuckle of said door leaf, said actuator being movable upon contact with said extension; and a proximity switch fixedly positioned in said knuckle of said frame leaf and responsive to the proximity of said actuator to indicate when the door is ajar.

10. A device for indicating the opened and closed position of a door as recited in claim 9 further comprising an actuator housing for mounting said actuator thereon, said actuator housing having means for releasably holding said actuator housing in said knuckle of said door leaf.

11. A device for indicating the opened and closed position of a door as recited in claim 9 further comprising a switch housing for mounting said proximity switch thereon, said switch housing having means for releasably holding said proximity switch in said knuckle of said frame leaf.

12. A device for indicating the opened and closed position of a door as recited in claim 9 further comprising means for urging said actuator toward said proximity switch.

13. A device for indicating the opened and closed psotion of a door as recited in claim 9 wherein said knuckle of said leaf frame is formed with a hinge pin, said hinge pin being engageable with said knuckle of said door leaf for rotation of said door about an axis substantially parallel to said jamb.

14. A device for indicating the opened and closed position of a door as recited in claim 13 wherein said hinge pin is formed with an extension, said extension being selectively engageable with said actuator to urge said actuator into position for alignment with said proximity switch when the door is closed.

* * * * *